United States Patent [19]

Pavolka

[11] Patent Number: 4,765,517

[45] Date of Patent: Aug. 23, 1988

[54] VALVE ARRANGEMENT WITH RETAINER BRACKET, FOR HOPPER CAR OUTLET GATE

[75] Inventor: John D. Pavolka, Michigan City, Ind.

[73] Assignee: Pullman Rail Leasing, Inc., Chicago, Ill.

[21] Appl. No.: 841,843

[22] Filed: Mar. 20, 1986

Related U.S. Application Data

[63] Continuation-in-part of Ser. No. 810,983, Dec. 9, 1985, abandoned.

[51] Int. Cl.[4] ..... B61D 7/26; B61D 7/20; B65D 47/20; B65D 90/60

[52] U.S. Cl. ..... 222/505; 74/422; 222/561; 105/282.3; 105/305

[58] Field of Search ..... 406/128, 130; 74/422, 74/29; 222/505, 559, 561; 105/305, 282.1, 282.3

[56] References Cited

U.S. PATENT DOCUMENTS

| | | | |
|---|---|---|---|
| 881,857 | 3/1908 | Harrington | 105/305 |
| 1,604,843 | 10/1926 | Lloyd | 105/282.3 X |
| 2,386,702 | 10/1945 | McBride | 105/282.3 |
| 2,517,534 | 8/1950 | Courtot | 251/250 X |
| 3,066,618 | 12/1962 | Gunnison | 105/282.3 |
| 3,348,501 | 10/1967 | Stevens et al. | 105/305 X |
| 3,693,846 | 9/1972 | Schuller | 406/130 |
| 4,027,921 | 6/1977 | Adler et al. | 406/130 |
| 4,214,536 | 7/1980 | Waddell et al. | 105/282.3 |
| 4,317,532 | 3/1982 | Przybylinski | 222/505 |
| 4,560,132 | 12/1985 | Wilder | 74/422 X |

*Primary Examiner*—Robert B. Reeves
*Assistant Examiner*—Scott H. Werny
*Attorney, Agent, or Firm*—Myers & Ehrlich, Ltd.

[57] ABSTRACT

A railway hopper car has a pneumatic discharge structure having a throat leading to a control tube from which lading is pneumatically withdrawn. The throat is opened and closed by valve plates supported on the ends of rods extending through bearings supported in the wall of the control tube. The rods have rack structures mounted thereon operatively engaged with pinion portions of operating shafts extending parallel to the control tube. Rotation of the operating shafts causes movement of the rods and valve plates. Retainer brackets are mounted on the rack structures and include retaining portions spaced and parallel to the rack structures. The pinion portions are supported between the rack structures and the retaining portions to maintain intermeshed engagement of the pinion portions with the rack structures. Stop portions are provided on the bracket which prevent movement of the valve plates beyond the fully open and fully closed positions.

22 Claims, 4 Drawing Sheets

FIG. 1
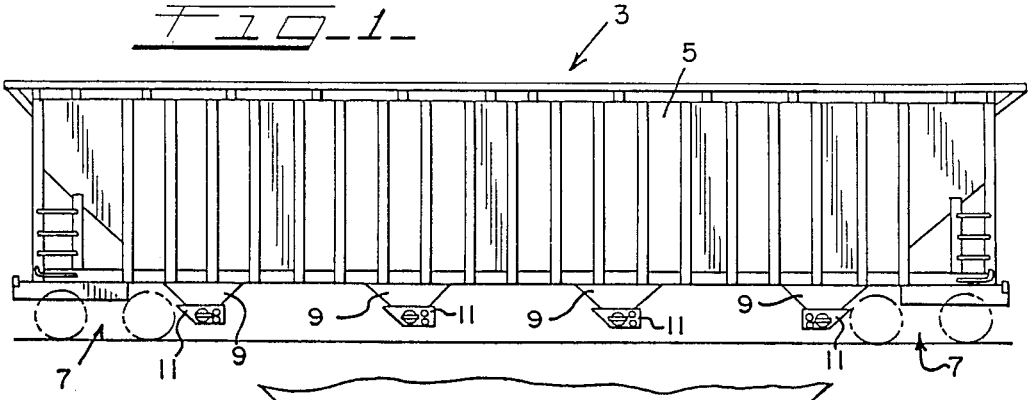
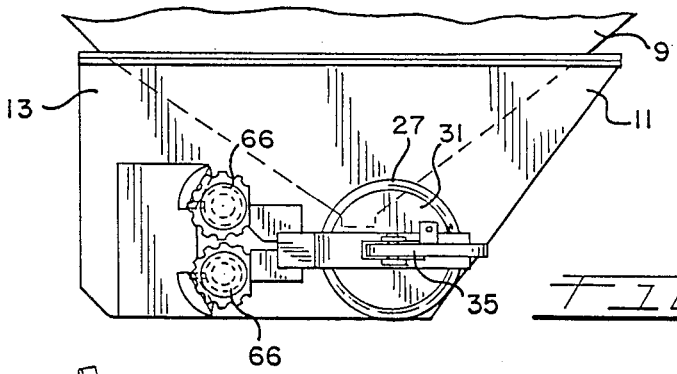
FIG. 2
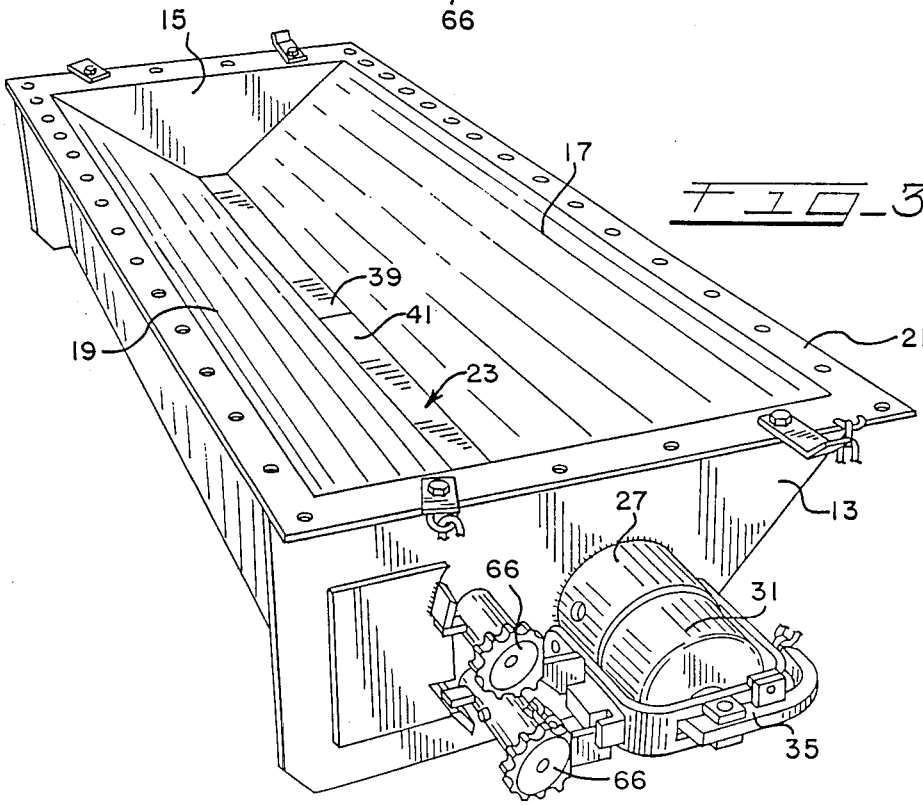
FIG. 3

VALVE ARRANGEMENT WITH RETAINER BRACKET, FOR HOPPER CAR OUTLET GATE

BACKGROUND OF THE INVENTION

1. Related Applications

This application is a continuation-in-part of U.S. patent application Ser. No. 810,983 filed Dec. 19, 1985, and entitled VALVE ARRANGEMENT FOR HOPPER CAR OUTLET GATE, now abandoned.

2. Field of the Invention

The present invention relates to pneumatic discharge arrangements located at the lower end of the discharge hoppers on railway cars. More particularly it relates to a mechanism for opening and closing the discharge structure valve on a railway car hopper.

3. Description of the Prior Art

It is well known in the prior art to equip a hopper car with a pneumatic discharge structure. The discharge structure generally comprises a pair of sloping walls defining a throat through which lading in the hopper car may pass into an outlet tube supported beneath the sloping walls. To control flow of the lading from the interior of the hopper car into the outlet tube, the throat is provided with one or more valve plates which are movable to open and close the throat.

Earlier designs provided for the valve plates being supported by slidable rods extending through a pair of aligned bushings in opposing walls of the outlet tube. Problems were encounted in the fabrication of the discharge structure because it was difficult to align the bushings to the tolerances required to prevent binding of the rods in sliding movement.

Also, no internal arrangement for limiting movement of the rods beyond the fully open and fully closed positions is disclosed in the prior art.

SUMMARY OF THE INVENTION

Accordingly, a primary object of this invention is to provide a pneumatic gate structure wherein the valve is supported by slidable rods extending through a single bushing in the outlet tube.

The use of a single bearing results in a cantilever structure supporting the valve which requires added structural support. This support is provided by a bracket mounted on each rod which engages an operating rod extending adjacent the hopper to provide a second support point for the rods and the valve. The rods are moved by a rack and pinion arrangement which the bracket keeps secured in meshed engagement to prevent slippage of the pinion gear, which would cause misalignment of the valve.

The rack and pinion securing bracket structure is adapted to be mounted on earlier designs of rack and pinion pneumatic gate hopper structures to retrofit the earlier design.

Stop arrangements are provided for limiting the movement of the rods and valve beyond the normal operating range.

Another object of this invention is to provide a gate valve carried by rod means having one bearing with the hopper discharge means and another bearing with a cantilever securing bracket stop arrangement limiting movement of the valve between opened and closed positions.

Another object of this invention is to provide a valve seal means providing a gap in the valve closed position so that lading material would not prevent closing of the valve means.

Another object of this invention is to provide an internal stop arrangement for the valve means which work in conjunction with an outside stop arrangement.

Another object of this invention is to provide a valve stop arrangement eliminating movement of rod means moving the valve means between opened and closed positions providing a no lading load position to a lading load position.

Another object of this invention is to provide a full length bushing for support of the valve operator rod means and wherein the pin driving rod means provides a cantilever second bearing support with a rack means operating the pinion means and wherein more bearing surface is provided on the retainer bracket supporting the valve in the closed loaded condition and wherein the pinion provides a second support point with the rack bracket carried on the valve rod means in the valve no lading load and valve open position and thereby eliminating two points of stress on the valve rod means by using one discharge bearing means and rack and pinion bracket means on the rod means and thereby eliminating the problem of lining up a valve position where two bearing points would have been used.

Other objects and advantages of the invention will be disclosed hereinafter in the specification and the scope of the invention will be articulated in the claims.

BRIEF DESCRIPTION OF THE DRAWINGS

FIG. 1 is an elevational view of a hopper railway car having pneumatic hopper outlet gates.

FIG. 2 is a detailed elevational view of the end of one of the pneumatic outlet gates.

FIG. 3 is a perspective view of a pneumatic outlet gate showing the interior of the hopper above the discharge throat.

DESCRIPTION OF THE PREFERRED EMBODIMENT

Figure 4:
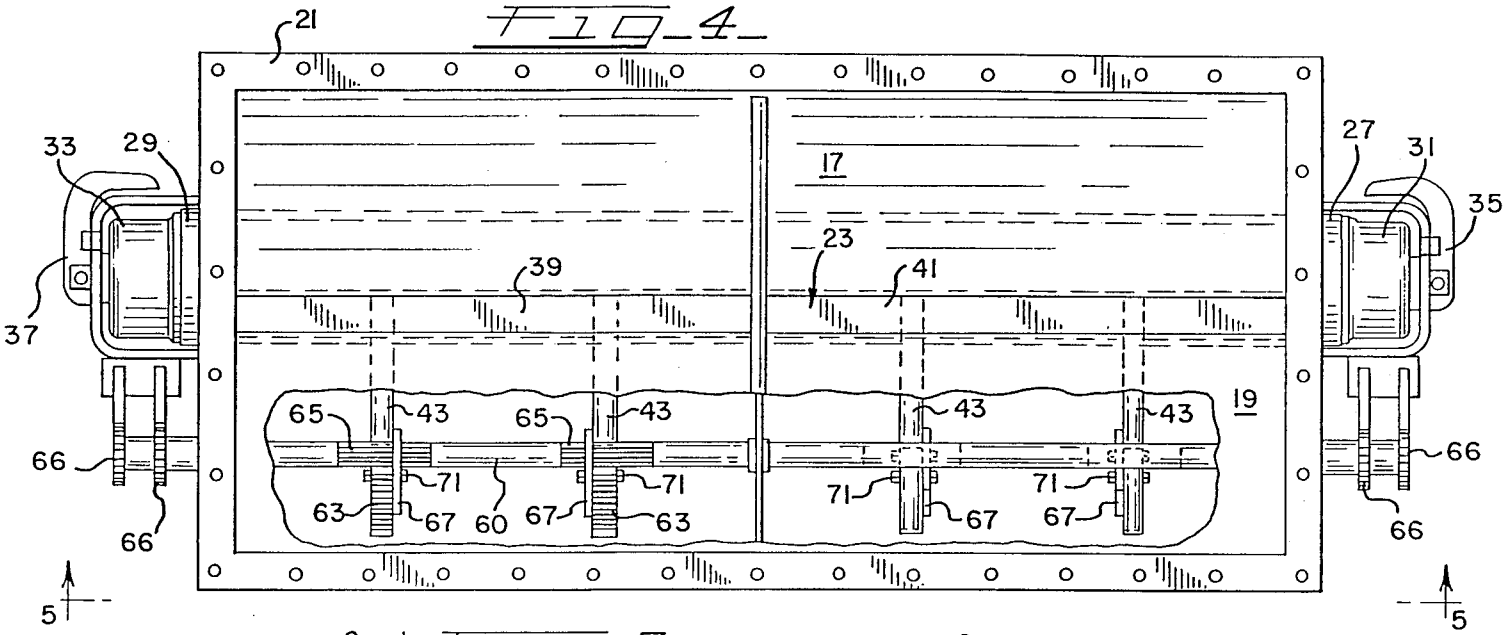
FIG. 4 is a plan view of a discharge hopper shown in FIG. 3, but having a portion of one of the slope sheets cut away to show the rack and pinion operating arrangement of this invention.

As best shown in FIG. 1, a railway hopper car 3 having a car body portion 5 is supported on conventional wheel truck assemblies generally indicated at 7. The lower end of the car body portion 5 is provided with a plurality of tapering hopper structures 9 through which lading in the hopper car 3 passes during unloading. Each of the hopper structures 9 is provided with a discharge arrangement or gate 11 for unloading lading in the hopper car 3.

As best shown in FIGS. 2, 3, 4 and 5, the gate 11 comprises a pair of generally vertical, laterally spaced end walls 13 and 15. A pair of opposing slope sheets 17 and 19 is supported between the end walls 13 and 15. Each gate 11 is attached to a hopper structure 9 using flanges 21 connected to the upper ends of slope sheets 17 and 19 and end walls 13 and 15.

The lower ends of slope sheets 17 and 19 are spaced apart to define an opening or throat generally indicated at 23. The throat 23 communicates between the interior of the gate 11 and the control tube 25 supported below the throat 23. The control tube 25 extends laterally of the car 3 and includes outlet tube portions 27 and 29 extending through the end walls 13 and 15, respectively. The outlet tube portions 27 and 29 are sealed by tube caps 31 and 33 secured by bails 35 and 37. The caps 31 and 33 may be removed from the outlet tube portions 27 and 29 and a vacuum intake (not shown) attached to unload lading in the car 3.

The throat 23 is covered by valve plates 39 and 41, each valve plate covering the throat 23 over half the length thereof. The valve plates 39 and 41 are supported on movable support rods 43 extending into the control tube 25, providing for generally horizontal movement of the valve plates 39 and 41 to open and close the throat 23.

Figure 6:
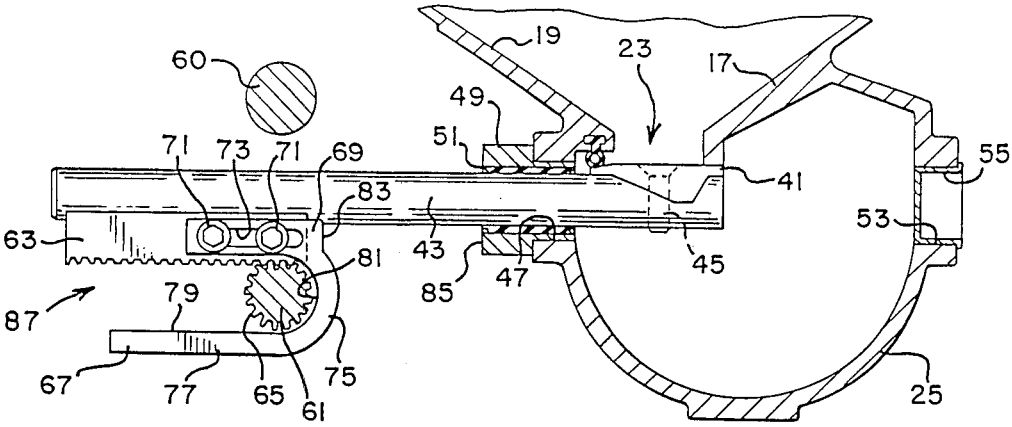
FIG. 6 is a partial section view taken along line 6—6 of FIG. 5 and showing the rack and pinion securing arrangement in use with a pinion gear on the lower operating shaft, with the pneumatic gate valve in the fully closed position.
Figure 7:
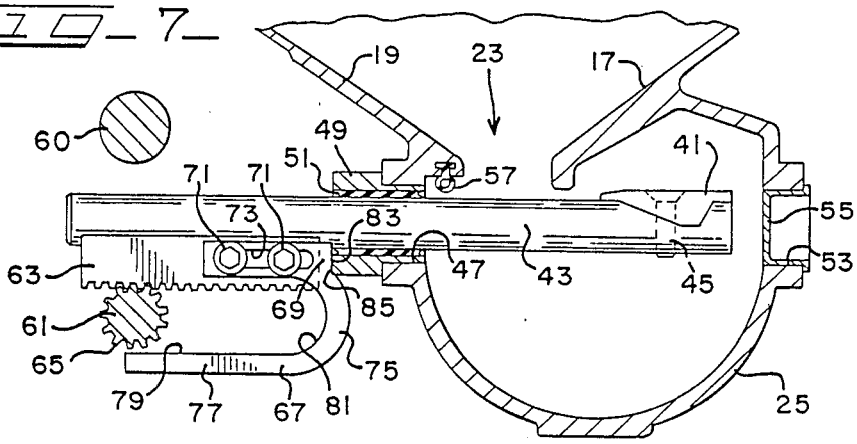
FIG. 7 is a view as in FIG. 6 but showing the pneumatic gate with the valve in the open position.
Figure 8:
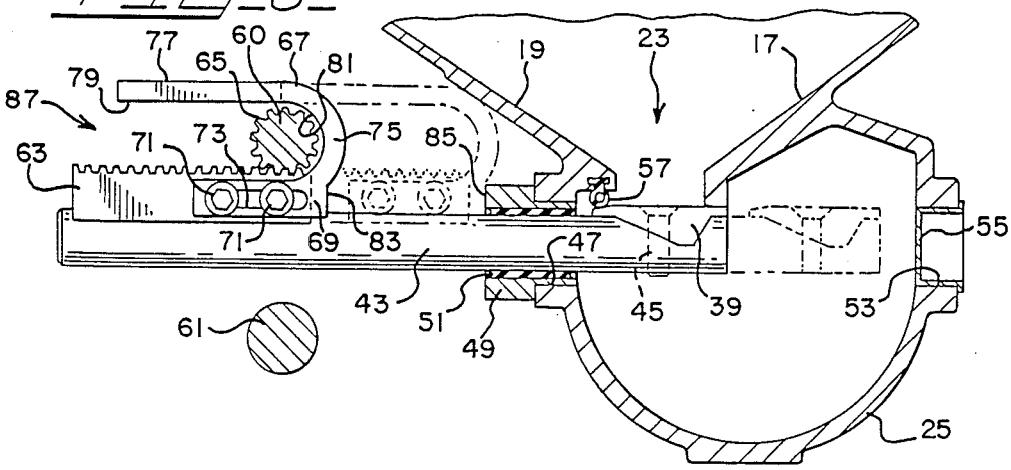
FIG. 8 is a partial section view taken along line 8—8 of FIG. 5, showing a rack and pinion retaining bracket of this invention engaging a pinion gear on the upper shaft in the valve closed position, and showing the valve-open position in phantom.

As best shown in FIGS. 6, 7, and 8, valve plates 39 and 41 are secured in recesses in rods 43 by securement means or bolts 45. The rods 43 extend through openings 47 in the control tube 25. Bushing retainers 49 supporting bushings 51 are mounted in openings 47 and support rods 43 for sliding horizontal movement therethrough for opening and closing the throat 23. A second opening 53 extends through the opposite wall of the control tube 25, and is closed by plug 55. In new construction, opening 53 is omitted and plug 55 is not required.

The rods 43 move the valve plates 39 and 41 independently to and from the open position (FIG. 7) and the closed position (FIG. 6). In the fully closed position, the valve plates 39 and 41 cover the throat 23, and a tight closure is insured by engagement with sealing member 57 attached to the lower end of slope sheet 19.

Figure 5:
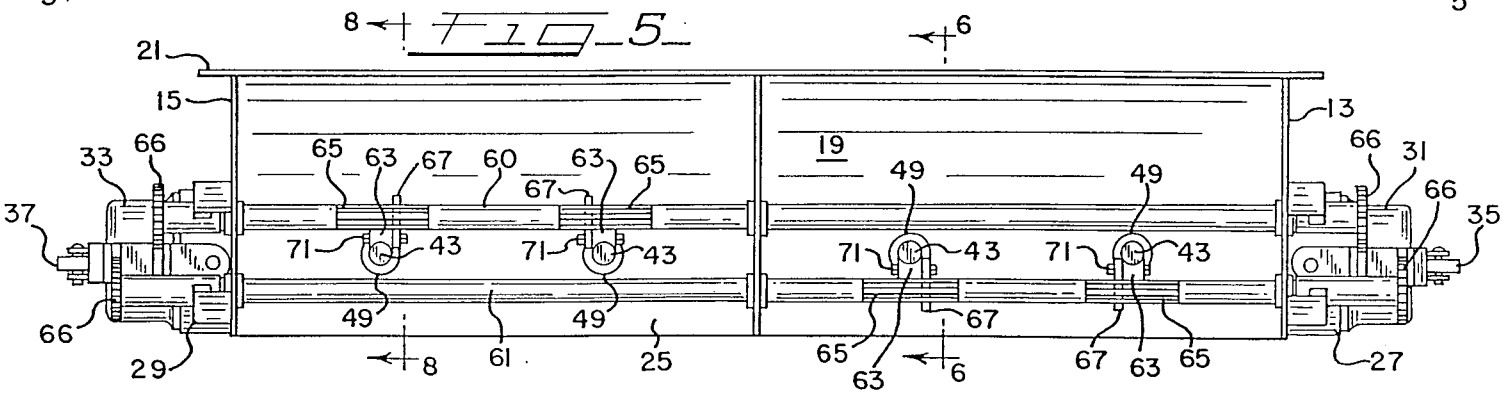
FIG. 5 is a view taken along line 5—5 of FIG. 4.

The rods 43 extend through the bushing 51, and horizontally outwardly therefrom between operating shafts 60 and 61. As best shown in FIG. 5, operating shafts 60 and 61 extend substantially the full length of the gate 11 and are rotatably supported on the end walls 13 and 15. The rods 43 have attached thereto rack structures 63 which are adapted to engage with one of the operating shafts 60 and 61. The operating shafts 60 and 61 are provided with pinion portions or longitudinal gear-tooth grooved portions 65 for co-acting with the rack structure 63 to move the rack structures 63 and the rods 43 horizontally responsive to rotation of the associated operating shafts 60 and 61. Handles 66 are provided at each end of each of the operating shafts 60 and 61 to allow an operator at either end of the gate 11 to rotate the shafts 60 and 61 manually to open and close the throat 23.

As best shown in FIGS. 6, 7, and 8, a retainer bracket 67 is provided to support the valves 39 and 41 and the rods 43 and to keep the pinion portion 65 in intermeshed engagement with rack structure 63. Retainer bracket 67 has a mounting portion 69. Mounting portion 69 is secured to one side of the rack structure 63 by mounting bolts 71 which extend through an adjustable mounting slot 73 in mounting portion 69. Arcuate intermediate portion 75 extends curvingly away from mounting portion 69 in the direction of the pinion portion 65. Horizontal retaining portion 77 extends horizontally from intermediate portion 75, and generally parallel to the path of movement of the rack structure 63 during operation. Pinion portion 65 is supported between the rack structure 63 and the horizontal retaining portion 77. Horizontal retaining portion 77 has an inner pinion retaining engagement surface 79. The pinion engagement surface 79 is engageable with the pinion portion 65 to preserve the intermeshed relationship between the pinion portion 65 and the rack structure 63 on the rod 43. The spacing between the horizontal portion 77 and the rack structure 63 prevents the pinion portion becoming disengaged from the rack structure 63 and misaligning the rods 43 and the valves 39 and 41.

Pinion retaining engagement surface 79 extends to the intermediate portion 75 of retainer bracket 67. The intermediate 75 has an inner arcuate pinion stop surface 81 which prevents the pinion portion 65 from being rotated beyond the point corresponding to the valve closed position as shown in FIGS. 6 and 8. Movement beyond the position corresponding to the valve fully open (see FIG. 7) is limited by open position stop portion 83 on mounting portion 69 of retainer bracket 67. When the pinion portion 65 is rotated to move the rack structure 63 and rod 43 to the open valve position, open position stop portion 83 engages abutment portion 85 of bushing retainer 49.

To allow for ready installation of retaining bracket 67, opening or space 87 is defined between the mounting portions 69 and horizontal retaining portion 77 to allow the retainer bracket 67 to be fitted directly over the operating shafts 60 and 61 in gate 11.

Figure 9:
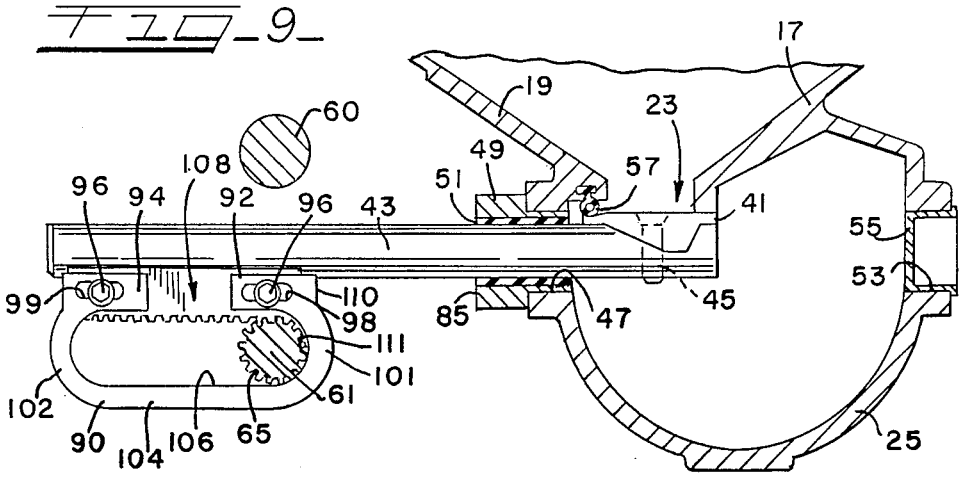
FIG. 9 is a partial section view as shown in FIG. 6, but showing an alternate embodiment of the retainer bracket.
Figure 10:
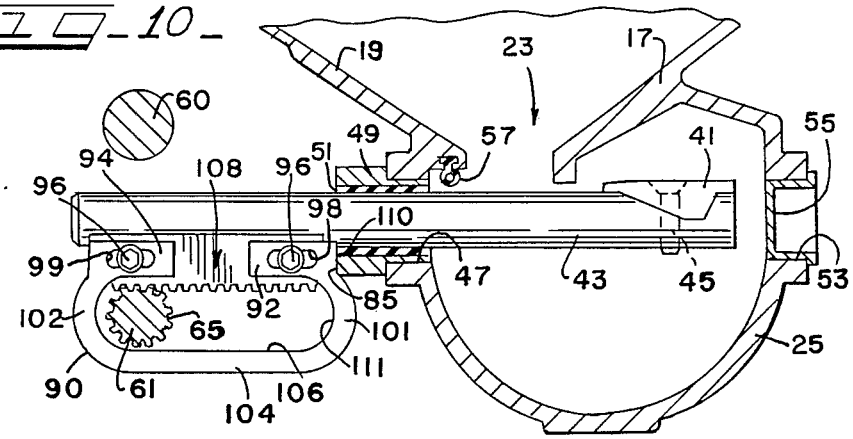
FIG. 10 is a view as in FIG. 7, but showing the alternate embodiment retainer bracket.
Figure 11:
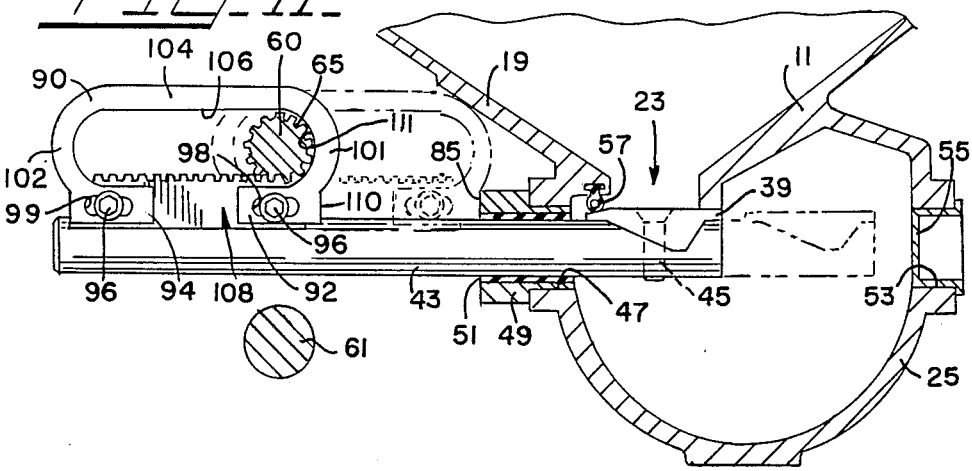
FIG. 11 is a view as in FIG. 8, but showing the alternate embodiment retainer bracket.

FIGS. 9, 10, and 11, disclose an alternate embodiment of applicant's invention. The retainer bracket 90 shown is used in a structural environment similar to that of the embodiment described above, and similar structures in FIGS. 9, 10, and 11 are given the same reference numbers as in the figures pertaining to the embodiment described above. FIGS. 9 and 10 show an alternate embodiment retainer bracket 90 connected to operatively engage the pinion portion 65 of the lower operating shaft 61. FIG. 11 shows a bracket 90 operatively engaged with the pinion portion 65 of the upper operating shaft 60.

Retainer bracket 90 is similar to retainer bracket 67, but is provided with two mounting portions 92 and 94 for added support. The mounting portions 92 and 94 are secured to the rack structure 63 by fastening means or bolts 96 extending through slots 98 and 99 therein. Slots 98 and 99 are elongated to permit adjusting lateral movement of the retainer bracket 90 when the bolts 96 are loosened.

Mounting portions 92 and 94 are connected to opposing arcuate portions 101 and 102 which extend away from the mounting portions 92 and 94 in the direction of the pinion portion 65 associated with the rack structure 63. Retaining portion 104 extends between arcuate portions 101 and 102 and has retaining surface 106 engageable with pinion portion 65 engagement of the rack structure 63 with pinion portion 65.

Mounting portions 92 and 94 define an opening 108 therebetween which communicates with the retaining surface 106. Opening 108 allows the retaining bracket 90 to be slipped over the pinion portion 65 during installation.

Mounting portion 92 has stop portion 110 which engages abutment surface 85 of bushing retainer 49 to limit movement of the rods 43 beyond the open position. Arcuate portion 101 has a stop surface 111 which engages pinion portion 65 to prevent movement of rods 43 beyond the valve closed position shown in FIGS. 10 and 11.

Description of Operation

When the hopper car is unloaded, the outlet tubes 27 and 29 are uncovered, and a vacuum intake is connected to one of the outlet tubes to draw air flow through the control tube 25. To ensure an efficient unloading process, the valve plate farther from the vacuum intake is opened first, and when the lading resting thereon has fallen through, the nearer valve plate is opened to allow the remaining lading to be unloaded.

The lading in the hopper car 3 when loaded rests on the slope sheet 17 and 19 and on the valve plates 39 and 41. The rods 43 extend through bushings 51 and support this load at one end in a cantilever structure. For full support of this cantilever valve arrangement, the end of the rod 43 outside of the outlet tube 25 must be secured against upward movement by a second support point.

When the rod 43 is operatively associated with a pinion portion 65 on the upper operating shaft 60 (see FIG. 8), the structure 63 to the pinion portion and the operating shaft 60, maintaining the rack and pinion intermesh and balancing the load on the valve plates.

When the rod 43 is operatively associated with a pinion portion 65 on the lower operating shaft 61 (see FIG. 6), the force of lading resting on the valve plate 41 results in an upward force at the opposite end of rod 43 which tends to cause the rod 43 and rack structure 63 to separate upwardly from the operating shaft 61. In the closed position, the retainer bracket 67 provides the second support point, firmly supporting the upward force by engaging the operating shaft 61 with the arcuate stop surface 81 and the horizontal stop surface 79. This engagement occurs directly below the point of connection of the bracket 67 to the rack structure 63, providing optimal structural support for balancing the cantilevered load.

The precise position of the valve plates 39 and 41 in the closed position may be adjusted by loosening mounting bolts 71 and moving retainer bracket 67 over the limited movement allowed by adjustable mounting slot 73. The bracket 67 is tightened again in a position wherein arcuate surface 81 engages the pinion portion 65 when the valve plates 39 and 41 are in the desired closed position.

Adjustment slot 73 also allows for vertical adjustment of the retainer bracket 67. The primary function of vertical adjustment is to provide the correct clearance between the pinion retaining surface 79, the pinion portion 65, and the rack structure 63. When the pinion portion 65 is in intermeshed engagement with the rack structure 63 the clearance of the pinion retaining surface 79 should be generally in the range of 0.001 to 0.010 inches. This clearance of the pinion is maintained throughout the range of travel of the retainer bracket 67 with respect to the pinion portion 65.

When the valve plate is moved to open the throat 23, the load on the valve plate is gradually reduced as the valve plate is moved away from the throat 23 and the depending lading therein, until finally the valve plate is fully withdrawn from the the throat 23, as shown in FIG. 7, in the open position. Similarly, the balancing cantilever force applied to bracket 67 gradually diminishes as the valve plate is withdrawn until, in the open position there is effectively no downward load on the valve plate, and no cantilever balancing load is required at the far end of rods 43.

Continued rotation of the operating shaft 61 tends to move the valve plate 41 and rods 43 further, potentially impacting the wall of the control tube 25 if a stop were not provided. Retainer bracket 67 is provided with a stop portion 83 which abuts an abutment portion 85 of the bushing retainer 49 when the valve plate reaches the open position. This abutment prevents further movement of the rods 43 and valve plates 39 and 41.

Space or gap 87 is provided to allow for ready installation of the bracket 67. Once the rack structure 63 is provided with openings to receive the securing bolts 71, the retainer bracket 67 may be mounted by placing the bracket 67 over the pinion portion 65 in the desired adjusted position and securing the bolts 71.

The operation of the alternate embodiment retaining bracket 90 shown in FIGS. 9, 10, and 11 is similar to that of the embodiment described above. The retainer bracket 90 is additionally supported by the second mounting portion 94, and loads created by the pinion portion 65 engaging the retaining surface 106 are transfered through arcuate portions 101 and 102 to the mounting portions 92 and 94, and to the associated rack structure 63. This allows a somewhat larger amount of clearance, the clearance distance between pinion portion 65 and retaining surface 106 being in the range of 0.000 to 0.020 inches.

Opening 108 between mounting portions 92 and 94 is provided to allow for ready installation of the bracket 90. Once the rack structure 63 is provided with openings for receiving bolts 96, the retainer bracket 90 may be mounted by passing the pinion portion 65 through the opening 108, and securing the bracket 90 to the rack structure 63.

Stop portion 110 in the alternate embodiment bracket 90 operates similarly to stop portion 83 in the preferred embodiment, and limits the range of movement of rods 43 when the valve is opened. Stop surface 111 operates similarly to stop surface 81 in the preferred embodiment to limit movement of the rods 43 beyond the valve-closed position and to support the valve plate 41 on rods 43 in a cantilever structure by engaging the pinion portion 65.

The foregoing description and drawings merely explain and illustrate the invention and the invention is not limited thereto, except insofar as the appended claims are so limited, as those skilled in the art who have this disclosure before them will be able to make modifications and variations therein without departing from the scope of the invention.

Wherefore I claim:

1. In a railway hopper car having a lading discharge structure, said lading discharge structure including:

a pair of spaced slope sheets having lower ends defining a first opening therebetween;

a control tube supported below the opening and having an interior communicating therewith;

a first operating shaft extending adjacent the control tube and being supported in said discharge structure for rotation with respect thereto;

rod means being movably supported with respect to the control tube, first valve means supported on the rod means for movement with respect to said opening for the opening and closing thereof;

rack means connected with the rod means and movable therewith; and the operating shaft having pinion means thereon engaging with the rack means for moving the rod means and the valve means to open and close the opening responsive to rotation of the operating shaft;

a first retainer bracket being supported on said rod means, said retainer bracket comprising:

a mounting portion supported on the rack means;

securement means for releasably securing the mounting portion on the rack means;

an intermediate portion connected with the mounting portion and extending away therefrom;

a retaining portion connected with the intermediate portion and having a retaining surface portion facing the rack means and extending generally parallel thereto;

the pinion means extending between the retaining surface portion and the rack means and being secured therebetween in intermeshed engagement with the rack means;

the retaining portion and the mounting portion defining a gap therebetween communicating with the retaining surface portion, said gap being large enough to permit passage of the operating shaft therethrough whereby the retainer bracket may be mounted and removed when the securement means is released without additional disassembly of the discharge structure.

2. The invention according to claim 1, and said intermediate portion having a pinion engaging surface engaging the pinion means when the valve means is moved to the closed position over the opening for preventing movement of the rod means and valve means beyond the closed position and for providing additional support for the valve means when in the closed position with lading resting thereon.

3. The invention according to claim 2, and the valve means in the closed position being spaced from the control tube to prevent lading from being trapped therebetween.

4. The invention according to claim 2, and the pinion engaging surface being generally vertically aligned with the mounting portion to provide structural support for loads received through the rod means from the valve means due to lading resting thereon when the valve means is in the closed position.

5. The invention according to claim 2, and said pinion engaging surface being generally arcuate to engage a substantial portion of the pinion means.

6. The invention according to claim 5 and the curvature of the pinion engaging surface being approximately equal to the outer curvature of the pinion means for substantial engagement therebetween.

7. The invention according to claim 1, and abutment means on said discharge structure, and the retainer bracket having a stop portion thereon adapted to engage the abutment means when the valve means is in the open position to prevent movement of the valve means and the rod means beyond the open position.

8. The invention according to claim 1 and said retaining portion providing a clearance between said retaining surface portion and said pinion means when said pinion means is in intermeshed engagement with said rack means, said clearance being generally within the range of 0.000 to 0.020 inches over the full range of travel of the rack means with respect to the pinion means.

9. The invention according to claim 1, and the mounting portion having an aperture therein, and the securement means extending through said aperture and being connected with the rack means, said aperture being large enough to allow for adjusting movement of the retainer bracket with respect to said rack means when said securement means is loosened.

10. The invention according to claim 1, and said slope sheets defining a second opening therebetween longitudinally removed from said first opening;

a second operating shaft extending generally parallel to the first operating shaft;

a second valve means operatively associated with the second operating shaft and adapted to cover and uncover said second opening;

a rod member supporting said second valve means;

said rod member having a rack structure thereon, said second operating shaft having a pinion portion engaged with said rack structure for moving said rod member responsive to rotation of said second operating shaft; and a second retainer bracket supported on the rack structure and having a retaining portion extending generally parallel to the movement of the rack structure and retaining the pinion portion in intermeshed engagement with the rack structure and providing cantilever support for the valve plate means and rod member.

11. The invention according to claim 10, and said second operating shaft being positioned vertically above the first operating shaft and said rod means and rod member extending between the first and second operating shafts.

12. The invention according to claim 1, and said intermediate portion having a pinion engagement surface adapted to engage the pinion means to stop movement of the valve means at the closed position.

13. The invention according to claim 12, and the mounting portion having adjustment means for adjusting the position of the retainer bracket with respect to the rod means for adjusting the position of the valve means in the closed position.

14. The invention according to claim 12, and the control tube and the valve means defining a space therebetween in the closed position for preventing lading from being trapped between the valve means and the control tube.

15. The invention according to claim 1, and said retainer bracket having stop means thereon for preventing movement of the rod means and the valve means beyond the open position.

16. In a railway hopper car having a lading discharge structure, said lading discharge structure including:

a pair of spaced slope sheets having lower ends defining an opening therebetween;

a control tube supported below the opening and having an interior communicating therewith;

a first operating shaft extending adjacent the control tube and being supported in said discharge structure for rotation with respect thereto;

rod means being movably supported with respect to the control tube, valve means supported on the rod means for movement with respect to said opening for the opening and closing thereof;

rack means connected with the rod means and movable therewith; and the operating shaft having pinion means thereon engaging with the rack means for moving the rod means and the valve means to open and close the opening responsive to rotation of the operating shaft;

a first retainer bracket being supported on said rod means, said retainer bracket comprising:

first and second mounting portions supported on the rack means;

first and second securement means for releasably securing the first and second mounting portions respectively to the rack means;

first and second intermediate portions connected with the respective mounting portion and extending generally away therefrom;

a retaining portion connected to the intermediate portions and having a retaining surface portion facing the rack means and extending between the intermediate portions;

the pinion means extending between the retaining surface portion and the rack means and being secured therebetween in intermeshed engagement with the rack means;

the first and second mounting portions defining an opening therebetween communicating with the retaining surface portion and being large enough to permit passage of the operating shaft when the first and second securement means are released whereby the retainer bracket may be mounted and removed from the discharge structure by release of the securement means and without additional disassembly of the discharge structure.

17. The invention according to claim 16, and stop means on said retainer bracket;

said stop means engaging the pinion means for limiting movement of the valve means beyond the closed position.

18. The invention according to claim 16, and stop means on said retaining bracket for limiting movement of the valve means beyond the open position.

19. The invention according to claim 16, and each of said mounting portions having an opening therein and;

the securement means each comprising releasable fastening means extending through said openings for securing the bracket to the rack means.

20. The invention according to claim 16, and the opening in the mounting portions being elongated to allow for adjusting movement of the bracket when the fastening means are released.

21. The invention according to claim 16 and each of said first and second intermediate portions having a generally concave surface portion adjacent the retaining surface portion, one of said generally concave surface portions engaging the pinion means in the closed position to act as a stop.

22. The invention according to claim 21 and the curvature of the concave surface portions being approximately equal to the outer curvature of the pinion means to provide substantial engagement therebetween for additional support of the rod means and the valve means in the closed position.

* * * * *